US006027544A

United States Patent [19]

Arvidsson

[11] Patent Number: 6,027,544

[45] Date of Patent: Feb. 22, 2000

[54] PROCESS FOR THE PREPARATION OF AN IRON-BASED POWDER

[75] Inventor: Johan Arvidsson, Nyhamnsläge, Sweden

[73] Assignee: Höganäs AB, Höganäs, Sweden

[21] Appl. No.: 09/234,515

[22] Filed: Jan. 21, 1999

Related U.S. Application Data

[63] Continuation of application No. PCT/SE97/01292, Jul. 18, 1997.

[30] Foreign Application Priority Data

Jul. 22, 1996 [SE] Sweden ..... 9602835

[51] Int. Cl.[7] ..... B22F 1/00

[52] U.S. Cl. ..... 75/255; 419/31; 148/508; 148/513

[58] Field of Search ..... 419/31; 75/255; 148/508, 513

[56] References Cited

U.S. PATENT DOCUMENTS

| | | | |
|---|---|---|---|
| 3,325,277 | 6/1967 | Huseby . | |
| 3,668,024 | 6/1972 | Johnson . | |
| 3,887,402 | 6/1975 | Kondo et al. | 148/126 |
| 3,900,309 | 8/1975 | Chao et al. . | |
| 4,234,168 | 11/1980 | Kajinaga et al. | 266/128 |
| 4,448,746 | 5/1984 | Kubo et al. | 419/31 |
| 4,519,852 | 5/1985 | Causton | 148/16 |
| 5,152,847 | 10/1992 | LeBeau et al. | 148/513 |
| 5,395,463 | 3/1995 | Johnen et al. | 148/513 |

FOREIGN PATENT DOCUMENTS

| | | |
|---|---|---|
| 1253740 | 11/1967 | Germany . |
| 1783068 | 5/1977 | Germany . |
| 1-176005 | 7/1989 | Japan . |

*Primary Examiner*—Ngoclan Mai
*Attorney, Agent, or Firm*—Burns, Doane, Swecker & Mathis, L.L.P.

[57] ABSTRACT

The invention concerns a process for producing a low-oxygen, low-carbon iron-based powder. The process comprises the steps of preparing a powder essentially consisting of iron and optionally at least one alloying element selected from the group consisting of chromium, manganese, copper, nickel, vanadium, niobium, boron, silicon, molybdenum, tungsten, decarburizing the powder in an atmosphere containing at least $H_2$ and $H_2O$ gases, measuring the concentration of at least one of the carbon oxides (alternatively gases) formed during the decarburisation process, or measuring the oxygen potential in at least 2 points located at a predetermined distance from each other in the longitudinal direction of the furnace, adjusting the content of the $H_2O$ gas in the decarburizing atmosphere with the aid of the measurement. Another alternative concerns measuring the carbon oxides in combination with measuring the oxygen potential.

50 Claims, 2 Drawing Sheets

Figure 1:
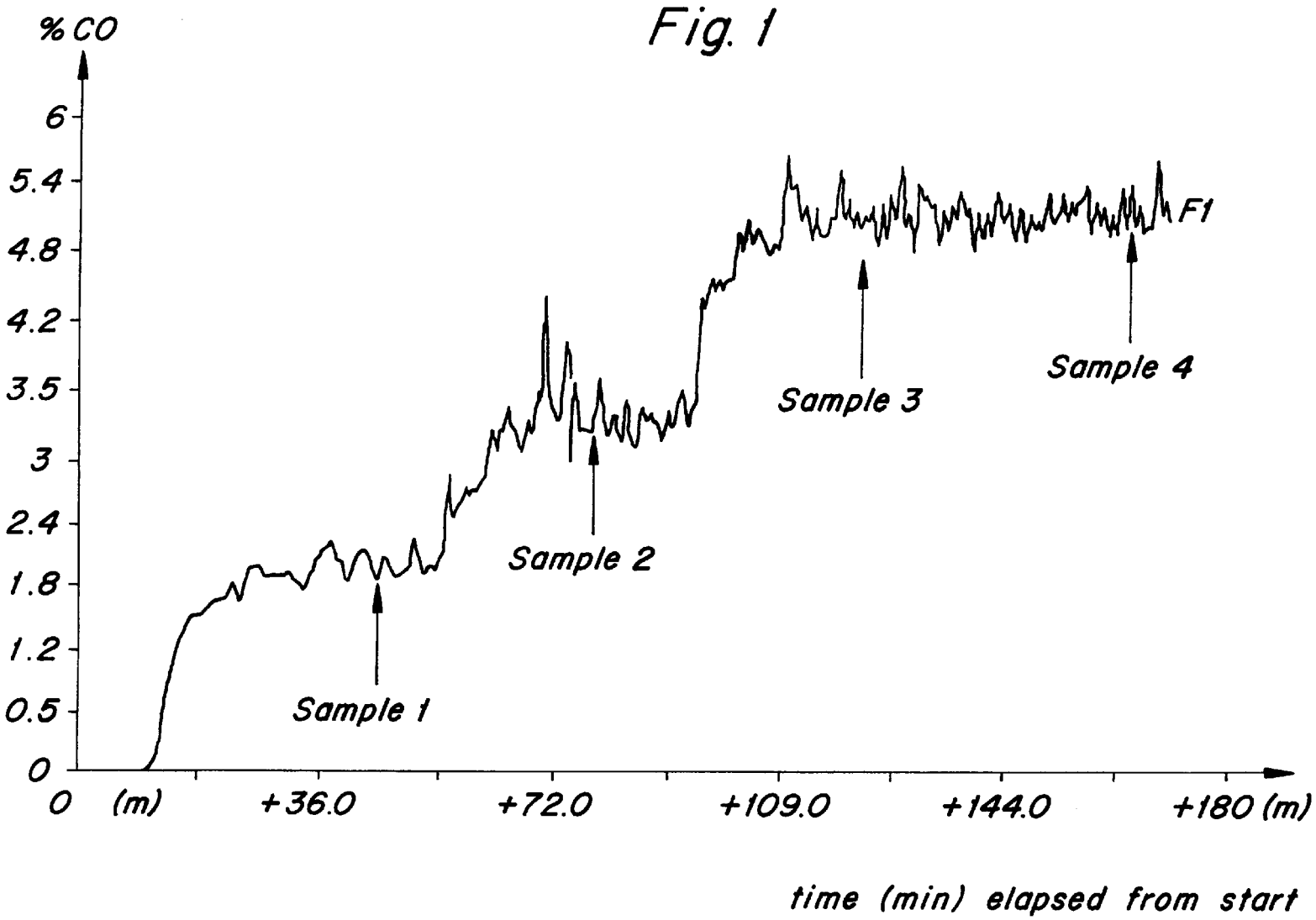

% CO
6
5.4
4.8
4.2
3.5
3
2.4
1.8
1.2
0.5
0
0 (m)
+36.0
+72.0
+109.0
+144.0
+180 (m)
time (min) elapsed from start
Sample 1
Sample 2
Sample 3
Sample 4
F1

PROCESS FOR THE PREPARATION OF AN IRON-BASED POWDER

This is a continuation of International Application No. PCT/SE97/01292, filed Jul. 18, 1997, that designates the United States of America and which claims priority from Swedish Application No. 9602835-2, filed Jul. 22, 1996.

The present invention concerns a process for preparing an iron-based powder. More specifically, the invention concerns an annealing process for producing a low-oxygen, low-carbon iron or steel powder.

Annealing of iron powders is of central importance in the manufacture of powder metallurgical powders and can briefly be described as follows.

The starting material for the annealing process, the so-called raw powder, consists of iron powder and optionally alloying elements, which have been alloyed with the iron in connection with the melting process. In addition to optional alloying elements, the raw powder usually includes the impurities carbon and oxygen in concentration ranges 0.2<%C<0.5 and 0.3<%O-tot<1.0 and minor amounts of sulphur and nitrogen. In order to obtain as good powder properties as possible, it is of outmost importance to eliminate as much as possible of these impurities, which is an important purpose of the annealing process according to the present invention.

Previously known processes aiming at the production of low-oxygen, low-carbon iron-based powder are disclosed in e.g. U.S. Pat. No. 4,448,746 and Japanese patent application 6-86601.

U.S. Pat. No. 4,448,746 concerns a process for the production of an alloyed steel powder having low amounts of oxygen and carbon. In this process, the amount of carbon of an atomised powder is controlled by keeping the powder in a decarburising atmosphere, which comprises at least $H_2$ and $H_2O$ gases during certain periods of treatment, which are determined by temperature and pressure conditions. The amount of oxygen of the starting powder is essentially the same or somewhat lower than that of the annealed powder.

Japanese patent application 6-86601 concerns a process, which is carried out in a special furnace including three consecutive chambers separated by partition walls. This process is also based on reduction with hydrogen gas and water steam.

These known processes, which are both carried out continuously, are based on the following two reactions:

1. $F_3C+6H_2(g)\rightarrow Fe+3CH_4(g)$

2. $Fe_3C+3H_2O(g)\rightarrow Fe+3CO(g)+3H_2(g)$

Principally it is possible to reduce both carbon and oxygen with hydrogen gas but the reaction with carbon according to the reaction 1 above is slow, for which reason water according to reaction 2 is added. The problem with the water addition is, however, that there is a risk that the powder is oxidised at the same time as the carbon is reduced. This risk is particularly great for alloyed powder materials comprising easily oxidising elements, which in turn means that it is necessary to be very "precise" when it comes to the adjustment of the ratio $P_{H_2}/P_{H_2}O$. The "optimal" ratio depends on a number of factors, of which the following are of major importance Carbon and oxygen contents of the raw powder Concentration and type of alloying elements Annealing temperature Residence time in the heating zone Thickness of the obtained powder cake The problem of adjusting the correct ratio is complicated, and an object of the present invention is to provide a new, improved and simplified process for producing a low-oxygen, low-carbon powder based on a method of controlling the reduction atmosphere and, as a consequence, the concentration of carbon and oxygen in the annealed final powder.

A distinguishing feature of the new process is that it can be carried out in existing furnace equipment such as conventional belt furnaces. The process is advantageously carried out continuously and countercurrently at temperatures between 800 and 1200° C. For alloyed powders the temperature preferably varies between 950 and 1200° C., whereas the process temperature for essentially pure iron powders preferably varies between 850 and 1000° C. It is however also possible to process essentially pure iron powders at higher temperatures, e.g. temperatures between 950 and 1200° C.

In brief, the process according to the invention includes the following steps:

a) preparing a powder essentially consisting of iron and optionally at least one alloying element selected from the group consisting of chromium, manganese, copper, nickel, vanadium, niobium, boron, silicon, molybdenum, tungsten;

b) annealing the powder in an atmosphere containing at least $H_2$ and $H_2O$ gases;

c) measuring the concentration of at least one of the carbon oxides formed during the decarburisation process, or d) measuring the oxygen potential essentially simultaneously in at least 2 points located at a predetermined distance from each other in the longitudinal direction of the rear end of the furnace, e) measuring the concentration according to c) in combination with measuring the oxygen potential in at least one point in the furnace f) adjusting the content of the $H_2O$ gas in the decarburising atmosphere with the aid of the measurements according to the steps c), d) and/or e).

The starting powder can be essentially any iron-based powder containing too high amounts of carbon and oxygen. The process is however especially valuable for reducing powders containing easily oxidisable elements, such as Cr, Mn, V, Nb, B, Si, Mo, W etc. The powder can be a sponge iron powder or an atomised, eg water atomised, powder. Optionally the starting powder is prealloyed.

Preferably the starting powder is a water-atomised, iron-based powder, which in addition to iron comprises at least 1% by weight of an element selected from the group consisting of chromium, molybdenum, copper, nickel, vanadium, niobium, manganese and silicon and has a carbon content between 0.1 and 0.9, preferably between 0.2 and 0.7% by weight and an oxygen/carbon weight ratio of about 1 to 3 and at most 0.5% of impurities.

In addition to the $H_2$ and $H_2O$ gases, the furnace atmosphere can also contain $N_2$, which also can be used as a protective gas in the exit end of the furnace, which is operated continuously and countercurrently. Other gases which might be present in the furnace atmosphere are $H_2S$ or $SO_2$ which are formed from sulphur of the raw powder. Depending on the composition of the raw powder, also other gases might be present.

The concentration of the carbon cases (carbon oxides) formed during the reaction is measured in the exit gas from the furnace by any conventional method such as by using an IR probe or analyser. Other methods of measuring the concentration of the carbon gases in the exit gas include mass spectrophotometric methods. Preferably carbon monoxide is measured.

An alternative way of monitoring the furnace atmosphere according to the invention is to measure the oxygen potential in the furnace atmosphere. This measurement has to be performed essentially simultaneously in at least 2 points located at a predetermined distance from each other in the rear end of the furnace, the points being arranged so that at least one point is closer to the furnace exit than the other point(s). The points should be significantly separated from each other, and the distance between the points, which is preferably decided by experimentation, since it depends on the furnace design, should not be less than about 0.2 meter.

According to a third alternative, the concentration of the carbon gas(es) is measured with an IR analyser and the oxygen potential is measured with an oxygen probe.

The addition of water or steam to the furnace is adjusted in view of the measurements to the amount, where the concentrations of carbon oxides are essentially constant. According to an embodiment of the invention, the measurements only concern the concentration of CO, and the water addition is adjusted to the value where the CO concentration in the exit gases is essentially constant as is disclosed in FIG. 1 and further explained in Example 1. below.

Figure 2:
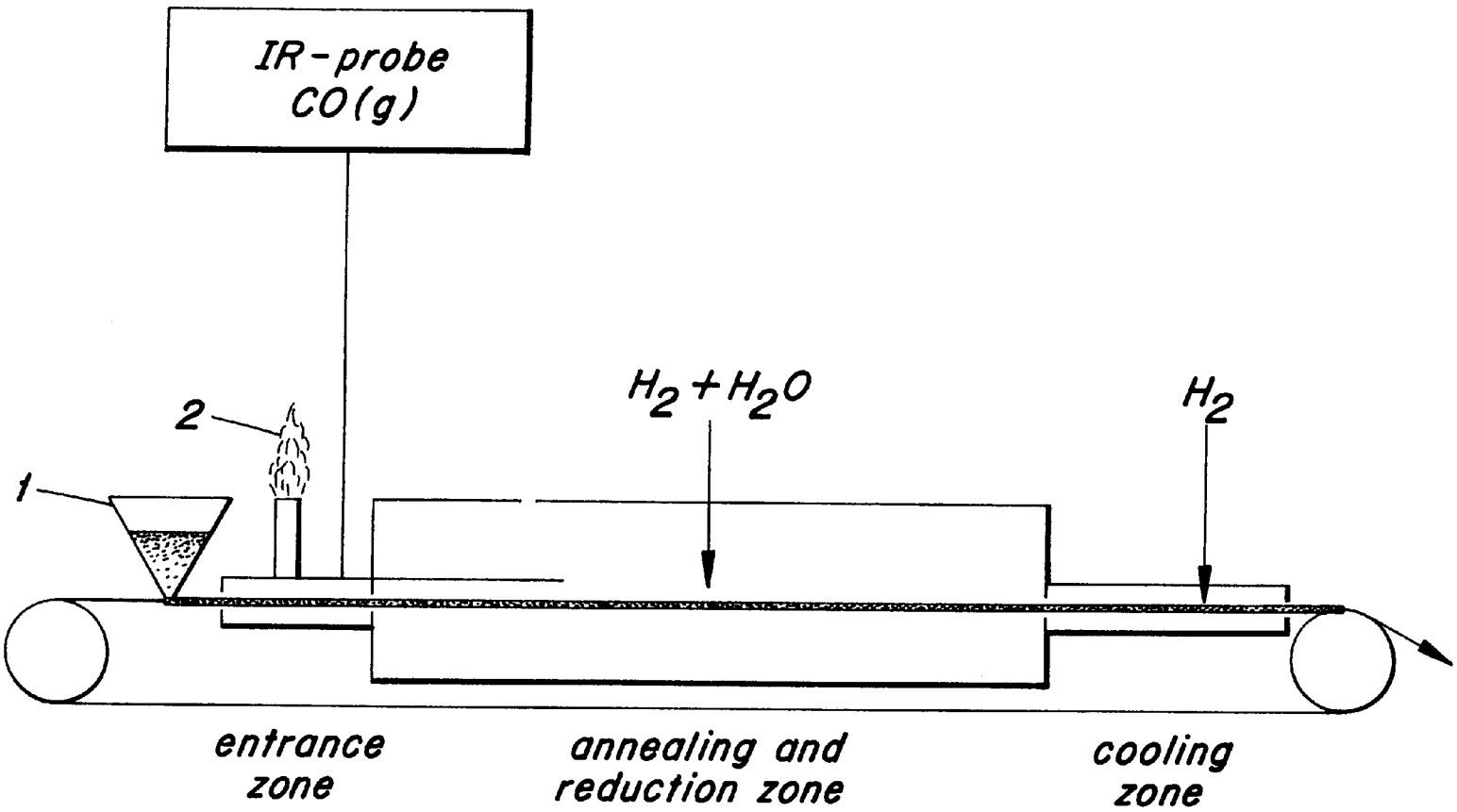

As indicated above the process according to the present invention is advantageously carried out continuously and countercurrently in a conventional belt furnace, which comprises an entrance zone, an annealing and a reduction zone and a cooling zone as disclosed in FIG. 2. The water steam (wet hydrogen gas) is injected in the annealing zone in one or more places where the formation of carbon oxides decreases.

In the embodiment of the invention where the oxygen potentials are measured, the addition of water and/or steam is adjusted to the amount, where there is essentially no difference in oxygen potential in points located near and at some distance from the exit end of the furnace as disclosed in Example 2 below.

The process according to the present invention is particularly useful for the preparation of novel, annealed, water-atomised, essentially carbon-free powder which in addition to iron comprises at least 1% by weight of any of the elements selected from the group consisting of chromium, molybdenum, copper, nickel, vanadium, niobium, manganese and silicon, not more than 0.2%, preferably not more than 0.15% by weight of oxygen, not more than 0.05%, preferably not more than 0.02% and most preferably not more than 0.015% of carbon and not more than 0.5% of impurities.

Preferably the amount of chromium is 0–5% by weight and most preferably 1–3% by weight. Molybdenum may be present in an amount of 0–5% by weight, preferably 0–2% by weight and copper in an amount of 0–2% by weight, preferably 0–1% by weight. The amount of nickel may vary between 0 and 10% by weight, preferably between 0 and 5% by weight. The amounts of niobium and vanadium may vary between 0 and 1% by weight, preferably between 0 and 0.25% by weight. Manganese may be present in an amount of 0–2% by weight, preferably 0–0.7% by weight and silicon in an amount of 0–1.5% by weight, preferably 0–1% by weight.

The invention is further illustrated by the following non-limiting Examples.

EXAMPLE 1

Controlling the process with one IR analyser

The process according to the invention was carried out continuously and countercurrently in a conventional belt furnace using the following conditions:

Annealing temperature: 1200° C. in the heating zone

Powder flow: about 35 kg/h

Total constant gas flow: 8 $Nm^3/h$ (dry and wet $H_{2(g)}$)

Composition of powder feed: Cr 3.0%, Mo 0.5%, C 0.61 $O_{tot}$ 0.36% by weight

A schematic view of the furnace including an IR analyser for measuring the CO concentration and for the addition of wet $H_2$ is shown in FIG. 2, wherein 1 designates a funnel for feeding the powder and 2 designates the exit gases which are burnt off after the measurements by the IR probe. FIG. 1 shows the values obtained by IR analyser.

Initially 8 $Nm^3/h$ of dry, inlet $H_2$ gas (dew point<−25° C.) (sample 1) was used. According to the IR analyser, the CO concentration was 2% in the exit gas. A sample of the annealed powder disclosed that the C content had been reduced to 0.40% and the O content to 0.018% by weight.

The composition of the gas was subsequently changed and 1.2 $Nm^3/h$ wet $H_2$ gas saturated with $H_2O$ at ambient temperature and 6.8 $Nm^3/h$ dry $H_2$ gas were used (sample 2). The IR analyser disclosed that the CO concentration had increased to 3.35%, and a sample of the powder had a C concentration of 0.240 and an O concentration of 0.019%

The composition of the inlet gas was subsequently changed to 2.4 $Nm^3/h$ wet $H_2$ gas saturated with $H_2O$ at ambient temperature and 5.6 $Nm^3/h$ dry $H_2$ gas (sample 3), which according to the IR analyser resulted in a CO concentration of 5.1%. Based on theoretical calculations this indicates virtually complete decarburisation. A sample annealed with this gas composition contains 0.050% C and 0.039% O.

When the composition of the inlet gas was finally changed to 3.6 $Nm^3/h$ wet $H_2$ gas saturated with $H_2O$ at ambient temperature and 4.4 $Nm^3/h$ dry $H_2$ gas (sample 4), the CO concentration (according to the IR analyser) was still 5.1% in the exit gas. The C concentration in a powder sample was decreased to 0.002 and the O concentration had increased to 0.135%, which indicates that less than 3.6 $Nm^3/h$ (and more than 2.4 $Nm^3/h$) wet $H_2$ gas should have been used if a lower O content is required. As can be seen from this example, the process according to the invention makes it possible to obtain a reduction in both C and O concentration of a metal powder by adjusting the ratio of dry and wet $H_2$ gas.

By using the process according to invention and adjusting the content of $H_2O$ in the decarburisation atmosphere with the aid of the CO content in the exit gas, the following results were obtained:

| | Before annealing | After annealing |
|---|---|---|
| | Iron Powder 3% Cr 1% Mn 0.25% Mo | |
| C | 0.25 | 0.007 |
| O | 0.5 | 0.05 |
| | Iron Powder 1.0% Cr; 0.6% Mn 0.25% Mo | |
| C | 0.25 | 0.005 |
| O | 0.5 | 0.12 |

-continued

| | Before annealing | After annealing |
|---|---|---|
| | Steel Powder 1.6% Cr 0.25% Mo | |
| C | 0.4 | 0.01 |
| O | 0.5 | 0.09 |

EXAMPLE 2

Controlling the process with two oxygen probes

Using two oxygen probes positioned 0.5 meter apart at the powder exit of the annealing zone, the reduction of the powder is controlled in the following way.

The furnace is fed with prealloyed powder, Fe-1 Cr-0.8 Mn–0.25 Mo containing 0.25% carbon and 0.50% oxygen by weight. The amount of hydrogen saturated with water is increased slowly to ensure steady state conditions in the reduction zone. The ratio hydrogen saturated with water/dry hydrogen, denoted R, goes from 0 to ⅓.

During the initial stage, when the amount of wet gas is zero, both oxygen probes show the same oxygen potential (equivalent to 0.08% by weight of O in the powder). At this stage, however, the reduction of carbon is insufficient, leaving as much as 0.05% by weight of C still in the powder, thus leading to an unacceptably poor compressibility of the powder.

As the amount of wet hydrogen is increased (R=⅕), the remaining carbon content goes down to 0.004% by weight without affecting the oxygen level in the powder, i.e. the two oxygen probes show the same oxygen potentials.

When this increase becomes too big (R>¼), probe No.1 shows an increase in oxygen potential (equivalent to 0.12% O). If the amount of wet hydrogen is further increased to R=⅓, so is the oxygen potential measured by probe No.1 (equivalent to 0.20% O) and also by probe No.2 (equivalent to 0.13% O). This leads to a difference in oxygen potential between probe No.1 and No.2, which is undesirable since it indicates a higher oxygen level in the powder.

As a consequence, the ratio wet hydrogen/dry hydrogen should be increased to up to, but not beyond, a level where both oxygen probes show similar and low oxygen potentials.

EXAMPLE 3

Controlling the process with One CO analyser and one oxygen probe

In this case, the increase of carbon monoxide due to increased amounts of wet hydrogen gas is monitored in the same manner as in Example 1. Concurrently the oxygen potential is monitored by either one or both oxygen probes described in Example 2. This enables controlling of the process in order to maximise the carbon and oxygen reduction simultaneously. With the same raw material as in Example 2 above, the ratio hydrogen saturated with water/dry hydrogen, R, is increased from zero to ⅓. Initially the measured level of CO(g) increases rapidly, but when reaching R=⅓, the CO(g) content has reached the steady state level. During the same period, no increase in oxygen potential has been observed in the cooling zone close to the annealing zone. It is still equivalent to 0.08% O in the powder.

There is no point in further increasing the ratio hydrogen saturated with water/dry hydrogen to ¼. It will not improve the carbon reduction, since this reaction has already reached steady state. On the contrary, the risk of increasing oxygen levels in the powder is very high, as demonstrated in Example 2 above.

I claim:

1. A process for producing a low-oxygen, low-carbon iron-based powder, which comprises the steps of:

a) preparing a powder consisting essentially of iron and optionally at least one alloying element selected from the group consisting of chromium, manganese, copper, nickel, vanadium, niobium, boron, silicon, molybdenum and tungsten;

b) annealing the powder in an atmosphere containing at least $H_2$ and $H_2O$ gases;

c) measuring the concentration of at least one of the carbon oxides formed during the decarburisation process, or d) measuring the oxygen potential essentially simultaneously in at least two points located at a predetermined distance from each other in the longitudinal direction of the furnace, or e) measuring the concentration according to c) in combination with measuring the oxygen potential in at least one point in the furnace;

f) adjusting the content of the $H_2O$ gas in the decarburising atmosphere with the aid of the measurement according to the steps c), d) or e).

2. The process according to claim 1, wherein the powder is a water atomised powder.

3. The process according to claim 1, wherein the process is carried out in a belt furnace comprising an entrance zone, an annealing and reduction zone and an exit zone.

4. The process according to claim 3, wherein the process is carried out continuously and countercurrently.

5. The process according to claim 3, wherein the process is carried out at a temperature between 800 and 1200° C.

6. The process according to claim 5, wherein $H_2O$ is injected in the annealing and reduction zone in one or more places where the formation of carbon oxides decreases.

7. The process according to claim 4, wherein the concentration of carbon oxide(s) is repeatedly measured in the exit gases from the furnace and the content of $H_2O$ is adjusted to the value when the concentration of the carbon oxide(s) in the exit gases is essentially constant.

8. The process according to claim 1, wherein the concentration of carbon monoxide is measured in step c).

9. The process according to claim 2, wherein the water-atomised powder comprises at least 1% by weight of an element selected from the group consisting of chromium, molybdenum, copper, nickel, vanadium, niobium, manganese and silicon and has a carbon content between 0.1 and 0.9% by weight, at most 0.5% impurities and wherein the weight % of oxygen/weight % of carbon is in the interval 1 to 3.

10. The process according to claim 2, wherein the water-atomised powder comprises at least 1% by weight of an element selected from the group consisting of chromium, molybdenum, copper, nickel, vanadium, niobium, manganese and silicon and has a carbon content between 0.2 and 0.7% by weight, at most 0.5% impurities and wherein the weight % of oxygen/weight % of carbon is in the interval 1 to 3.

11. The process according to claim 1, wherein the powder comprises an annealed, water-atomised, essentially carbon-free iron-based powder, which in addition to iron comprises at least 1% by weight of any of the elements selected from the group consisting of chromium, molybdenum, copper, nickel, vanadium, niobium, manganese and silicon, not more than 0.2% by weight of oxygen, not more than 0.05% of carbon and not more than 0.5% of impurities.

12. The process according to claim 1, wherein the powder comprises an annealed, water-atomised, essentially carbon-free iron-based powder, which in addition to iron comprises at least 1% by weight of any of the elements selected from the group consisting of chromium, molybdenum, copper, nickel, vanadium, niobium, manganese and silicon, not more than 0.15% by weight of oxygen, not more than 0.02% of carbon and not more than 0.5% of impurities.

13. The process according to claim 1, wherein the powder comprises an annealed, water-atomised, essentially carbon-free iron-based powder, which in addition to iron comprises at least 1% by weight of any of the elements selected from the group consisting of chromium, molybdenum, copper, nickel, vanadium, niobium, manganese and silicon, not more than 0.15% by weight of oxygen, not more than 0.015% of carbon and not more than 0.5% of impurities.

14. The process according to claim 1, wherein the powder includes chromium in an amount of 0 to 5% by weight.

15. The process according to claim 1, wherein the powder includes chromium in an amount of 1 to 3% by weight.

16. The process according to claim 1, wherein the powder includes molybdenum in an amount of 0 to 5% by weight.

17. The process according to claim 1, wherein the powder includes molybdenum in an amount of 0 to 2% by weight.

18. The process according to claim 1, wherein the powder includes copper in an amount of 0 to 2% by weight.

19. The process according to claim 1, wherein the powder includes copper in an amount of 0 to 1% by weight.

20. The process according to claim 1, wherein the powder includes nickel in an amount of 0 to 15% by weight.

21. The process according to claim 1, wherein the powder includes nickel in an amount of 0 to 5% by weight.

22. The process according to claim 1, wherein the powder includes 0 to 1% by weight of niobium.

23. The process according to claim 1, wherein the powder includes 0 to 0.25% by weight of niobium.

24. The process according to claim 1, wherein the powder includes 0 to 1% by weight of vanadium.

25. The process according to claim 1, wherein the powder includes 0 to 0.25% by weight of vanadium.

26. The process according to claim 1, wherein the powder includes manganese in an amount of 0 to 2% by weight.

27. The process according to claim 1, wherein the powder includes manganese in an amount of 0 to 0.7% by weight.

28. The process according to claim 1, wherein the powder includes silicon in an amount of 0 to 1.5% by weight.

29. The process according to claim 1, wherein the powder includes silicon in an amount of 0 to 1% by weight.

30. The process according to claim 1, wherein the measurements are made continuously.

31. The process according to claim 1, wherein the measurements are made by using an IR detector.

32. An annealed, water-atomised, essentially carbon-free powder prepared according to the process of claim 1 which, in addition to iron, comprises at least 1% by weight of any of the elements selected from the group consisting of chromium, molybdenum, copper, nickel, vanadium, niobium, manganese and silicon, not more than 0.2% by weight of oxygen, not more than 0.05% of carbon and not more than 0.5% of impurities.

33. An annealed, water-atomised, essentially carbon-free powder prepared according to the process of claim 1 which, in addition to iron, comprises at least 1% by weight of any of the elements selected from the group consisting of chromium, molybdenum, copper, nickel, vanadium, niobium, manganese and silicon, not more than 0.15% by weight of oxygen, not more than 0.02% of carbon and not more than 0.5% of impurities.

34. An annealed, water-atomised, essentially carbon-free powder prepared according to the process of claim 1 which, in addition to iron, comprises at least 1% by weight of any of the elements selected from the group consisting of chromium, molybdenum, copper, nickel, vanadium, niobium, manganese and silicon, not more than 0.15% by weight of oxygen, not more than 0.015% of carbon and not more than 0.5% of impurities.

35. The powder according to claim 32 comprising chromium in an amount of 0 to 5% by weight.

36. The powder according to claim 32 comprising chromium in an amount of 1 to 3% by weight.

37. The powder according to claim 32 comprising molybdenum in an amount of 0 to 5% by weight.

38. The powder according to claim 32 comprising molybdenum in an amount of 0 to 2% by weight.

39. The powder according to claim 32 comprising copper in an amount of 0 to 2% by weight.

40. The powder according to claim 32 comprising copper in an amount of 0 to 1% by weight.

41. The powder according to claim 32 comprising nickel in an amount of 0 to 15% by weight.

42. The powder according to claim 32 comprising nickel in an amount of 0 to 5% by weight.

43. The powder according to claim 32 comprising 0 to 1% by weight of vanadium.

44. The powder according to claim 32 comprising 0 to 0.25% by weight of vanadium.

45. The powder according to claim 32 comprising 0 to 1% by weight of niobium.

46. The powder according to claim 32 comprising 0 to 0.25% by weight of niobium.

47. The powder according to claim 32 comprising manganese in an amount of 0 to 2% by weight.

48. The powder according to claim 32 comprising manganese in an amount of 0 to 0.7% by weight.

49. The powder according to claim 32 comprising silicon in an amount of 0 to 1.5% by weight.

50. The powder according to claim 32 comprising silicon in an amount of 0 to 1% by weight.

* * * * *